United States Patent [19]

Kelch et al.

[11] 4,039,780

[45] Aug. 2, 1977

[54] ELECTRIC TAXIMETER MOUNTING AND DEMOUNTING ARRANGEMENT

[75] Inventors: Heinz Kelch, Buchenberg; Eduard Schuh, Villingen-Schwenningen, both of Germany

[73] Assignee: Kienzle Apparate GmbH, Villingen-Schwenningen, Germany

[21] Appl. No.: 579,817

[22] Filed: May 22, 1975

[30] Foreign Application Priority Data

June 1, 1974 Germany ..... 2426733

[51] Int. Cl.[2] ..... G07B 13/00

[52] U.S. Cl. ..... 235/30 R; 235/33; 235/45

[58] Field of Search ..... 235/30 R, 30 A; 317/120; 310/8.3; 339/10, 144, 147

[56] References Cited

U.S. PATENT DOCUMENTS

| | | | |
|---|---|---|---|
| 2,748,359 | 5/1956 | Swan | 339/10 X |
| 3,137,212 | 6/1964 | Rose | 317/120 X |
| 3,254,833 | 6/1966 | Condy et al. | 235/30 R |
| 3,388,859 | 6/1968 | Kelch et al. | 235/30 R |
| 3,464,531 | 9/1969 | Herr et al. | 310/8.3 X |

FOREIGN PATENT DOCUMENTS

| | | | |
|---|---|---|---|
| 761,390 | 11/1956 | United Kingdom | 235/30 |

*Primary Examiner*—Ulysses Weldon
*Attorney, Agent, or Firm*—Michael J. Striker

[57] ABSTRACT

A mounting and demounting arrangement for an electric taximeter permits a mechanical-to-electrical converter to be slidably received into electrical contact with a socket provided in the taximeter housing or, at the option of a user, the mechanical-to-electrical converter is mounted at a location remote from the housing in order to protect a flexible shaft mechanically coupled to the converter from severe flexing.

6 Claims, 4 Drawing Figures

FIG.1
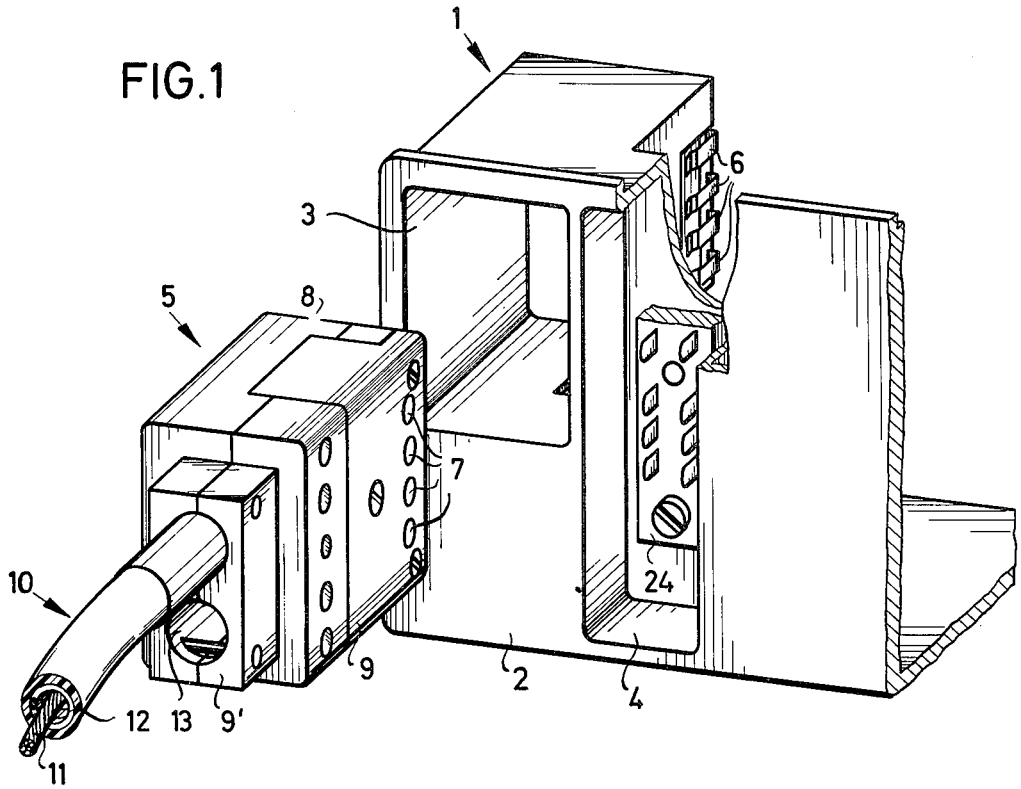
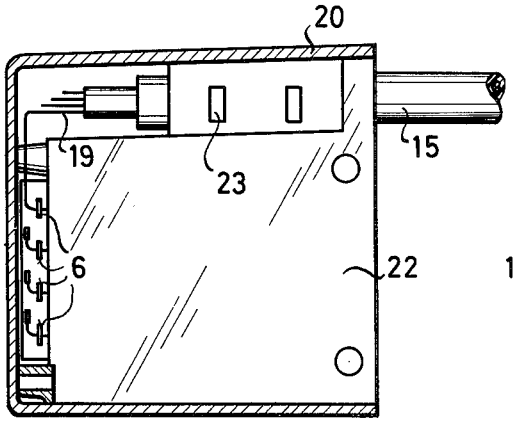
FIG. 3a
FIG. 3b
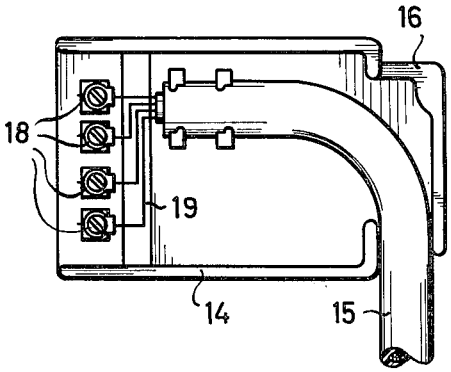

ELECTRIC TAXIMETER MOUNTING AND DEMOUNTING ARRANGEMENT

BACKGROUND OF THE INVENTION

The present invention relates to taximeters, and more particularly to a mounting and demounting arrangement for taximeters.

Taximeters are devices which indicate passenger fares as a function of the distance and/or time variables measured by the vehicle containing the taximeter. These variables are directly related to the mechanical motion of the vehicle, and more particularly to a drive component; i.e., any element which indicates the motion of the vehicle, for example the crankshaft or main shaft which is linked to the transmission of the vehicle.

It is known in the prior art to use a converter or transducer, which is mechanically coupled to a flexible drive shaft, to convert the available drive component into a series of electrical pulses which is then processed by electronic circuitry and, thereupon, used to indicate passenger fares.

Difficulties have arisen as to where and how to mount the transducer relative to the taximeter housing. One factor to be considered is that the tachometer also includes a mechanical flexible driveshaft and that this shaft, as well, is to be mechanically connected to the transducer.

Another critical factor to be considered is the spatial relationship between the drive component and the taximeter housing. The housing is generally located in the front portion of the vehicle adjacent the driver and mounted at an elevation so that the passenger can readily read the indicated fare; the drive component is generally located below and forwardly of the passenger compartment. In short, the flexible mechanical shaft connected with the drive component must traverse a complex three-dimensional distance in order to be directly connected with the taximeter housing. However, although these mechanical shafts are flexible, they impose the additional requirement that they are inoperative if they are bent in sharp radius bends. This aspect greatly complicates the mounting arrangement.

Another factor to be considered is that the mounting arrangement must be relatively quick and service-free. Initial installation, subsequent maintenance repairs or readjustment of the gears of the taximeter to accommodate different fare rates are operations which are all required to be done efficiently and quickly.

The prior art has not adequately resolved these aforementioned factors. One approach of the prior art has proposed screw-tight connections between the mechanical flexible shaft and the taximeter housing; thus making disconnection difficult and time-consuming, especially when threaded coupling nuts are used. Other approaches have used separate series-connected transducers which must be specially mounted. The electric wire for the transducers must be initially soldered in situ with the transducer at one end of the wire in a separate soldering operation and then soldered again in situ with the electronic circuitry of the taximeter at the other end of the wire. Thus, servicing is difficult because of the time and labor involved in the mounting and demounting operations of the prior art.

SUMMARY OF THE INVENTION

Accordingly, it is the general object of the present invention to overcome the disadvantages of the prior art.

More particularly, it is an object of the present invention to provide a mounting and demounting arrangement which is efficient to service.

Another object is to eliminate screw-threaded mechanical connections between the mechanical drive flexible shaft and the taximeter housing.

A further object is to eliminate the need for separate in situ soldering operations of the electrical connections between the transducer and the taximeter housing.

An additional object is to provide a mounting and demounting arrangement which does not subject the mechanical drive flexible shaft to sharp radius bends.

In keeping with these objects and others which will become apparent hereinafter, one feature of the mounting arrangement is to provide the taximeter housing with wall portions defining a socket containing first electrical contact means. Means for converting the mechanical motion of a drive component of the vehicle containing the taximeter into the electrical signals required for operation of the taximeter comprises a plug-in member having second electrical contact means. The plug-in member is dimensioned so as to be slidably received in the socket so that, when the plug-in member is fully inserted therein, the first and second electrical contact means are positioned in direct electrical contact with each other.

The plug-in member is a mechanical-to-electrical transducer or converter; alternatively, it is an electrical connector having an electrical cable assembly electrically connected to an auxiliary housing containing an aperture which is adapted to receive a mechanical-to-electrical converter and complete an electrical connection therewith.

These features assure an efficient servicing arrangement which replaces the screw-threaded mechanical connections of the prior art by providing a simple plug-in and plug-out engagement. Furthermore, the screw-threaded electrical cables do not have to be soldered in situ.

In addition, one of the electrical contact means is preferably formed of resilient spring contacts which serve as snap-in and snap-out mounting members to facilitate the mechanical securement of the plug-in members in place and thereby to prevent their unauthorized withdrawal.

Moreover, the plug-in members are preferably formed with extension portions which project outwardly of the socket when the members are fully inserted therein. These extensions serve as convenient hand-grips to facilitate mounting and demounting.

Still further, since one has the option of plugging the converter or the electrical connector into the socket of the taximeter housing, the mechanical drive flexible shaft will not be subjected to sharp radius bends. The mechanical drive flexible shaft, by being mechanically coupled to a mechanical-to-electrical converter at a location away from the taximeter housing, need not traverse any complicated three-dimensional or maze-like path; instead a flexible electrical cable connected to the converter will traverse this path to the taximeter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective, partially-sectioned, fragmentary view of an embodiment according to the present invention;

DESCRIPTION OF THE PREFERRED EMBODIMENTS

Figure 2:
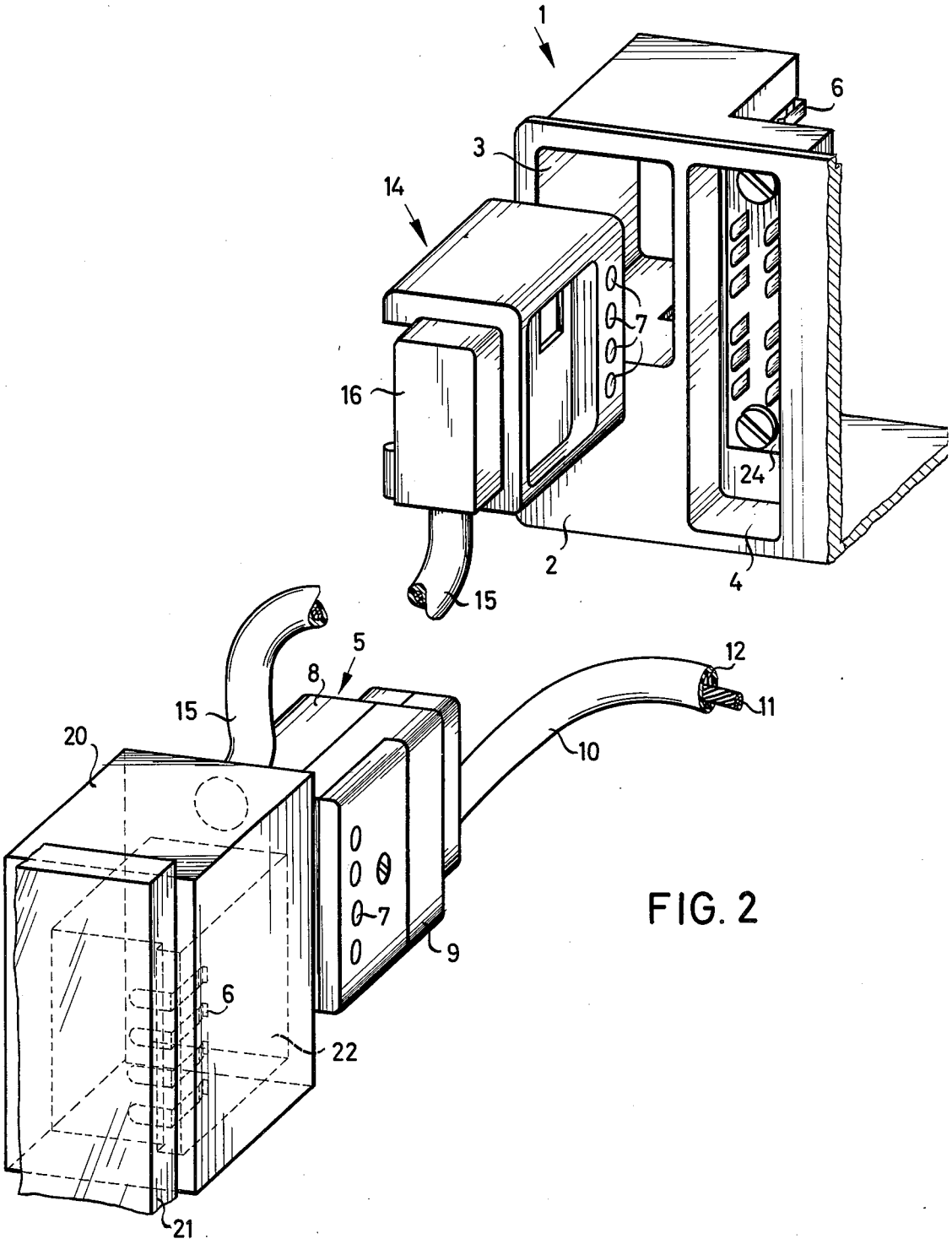
FIG. 2 is a perspective, partially-sectioned, broken-away view of a second embodiment according to the present invention; and FIGS. *3a, 3b* are partially-sectioned enlarged views of details of the embodiment of FIG. 2.

Discussing firstly the embodiment which has been illustrated in FIG. 1, reference numeral 1 identifies the partially shown electric taximeter housing having a rear wall 2. The housing 1 has wall portions defining a socket 3. Along one of these wall portions, for example, the right side wall of FIG. 1, first electrical contact means 6 is provided which comprises a plurality of resilient electrical spring contacts, preferably made of electrically-conductive spring steel material or the like. No details are shown of the taximeter mechanism; these are known per se and form no part of this invention.

Means for converting the mechanical motion of a drive component of the vehicle containing the taximeter into electrical signals required to operate the latter is generally identified in the embodiment of FIG. 1 by reference numerals 5 and 10.

In the embodiment of FIG. 2, the means for converting is generally identified by reference numerals 10, 5, 20, 15 and 14.

In both embodiments, the drive component of the vehicle (not illustrated) is mechanically coupled to the mechanical drive means 10 which comprises a core or flexible drive shaft 11 and an outer surrounding flexible cover 12. The mechanical drive means 10 is connected by means of a non-illustrated connecting gear to a mechanical-to-electrical transducer or converter 5 whose function is to generate a series of electrical signals or impulses which are dependent upon the drive component of the vehicle. The point of distinction between the two embodiments is the location at which the mechanical-to-electrical conversion takes place; i.e. locally in the taximeter housing 1 itself (FIG. 1), or remotely at a location away from the taximeter housing 1 (FIG. 2).

In both embodiments, a plug-in member (5 or 14) has second electrical contact means 7 which is slidably received in the socket 3. Upon full insertion therein, the second electrical contact means 7, which comprises a plurality of electrical surface contacts, are brought into direct electrical contact with a plurality of resilient spring contacts 6. During insertion, the resilient contacts 6 are urged outwardly of the socket and simultaneously serve as a housing or locating device for the proper installation of the plug-in member.

Plug-in member 5 is a mechanical-to-electrical converter which is well known in the art. For example, one such converter is described in greater detail in U.S. Pat. No. 3,388,859 to Kelch et al, issued June 18, 1968, the entire contents of which are hereby incorporated by reference.

For purposes of clarity, the coverter 5 has been divided into two housing portions. Housing portion 8 contains all of the mechanicl controls, such as interchangeable gears and the like; housing portion 9 contains the electrical controls. As discussed in the aforementioned patent, the mechanical drive means 10 which is mechanically linked to the mechanical controls in housing portion 8 rotates a shaft upon which an apertured disk is mounted. A light source is mounted on one side of the disk, and photoelectric means, such as a light barrier, is provided on the opposite side. As the drive component which is dependent upon the distance and/or time variables of the vehicle is operated, the apertured disk will be caused to rotate in a manner which is dependent upon these same variables. The photoelectric means will thus generate a series of electrical pulses whose period and/or amplitude and/or time-sequence characteristics are forwarded to the electronic circuitry associated with the fare-indicating device of the taximeter. If desired, the converter 5 may be opened and the gears provided in housing portion 8 may be interchanged so as to furnish different taximeter rates.

Upon assembly, the housing portions 8 an 9 have a rectangularly-shaped configuration which permits easy entry into the socket 3 whose sides are cooperatively disposed at right angles to each other.

Housing extension 9' is provided on plug-in member 5 and projects outwardly of the socket 3 when the plug-in member 5 is fully inserted therein. This provides a convenient hand-grip for a user to mount and demount the plug-in member 5.

Plug-in member 5 is further provided with at least two openings 13, one of which is adapted to receive the mechanical drive means 10, the other of which may be used, if desired, to connect a second mechanical drive flexible shaft for a tachometer or a tachograph.

Turning more specifically to the embodiment of FIG. 2, it will be seen that like numerals identify identical elements. The mechanical drive means 10 is mechanically coupled to the mechanical-to-electrical converter 5; however, the converter 5 is not slidably received into the socket 3 of the housing 1. Instead, auxiliary housing 20 having wall portions defining aperture 22 slidably receives the converter 5.

The aperture 22 of auxiliary housing 20 has auxiliary first electrical contact means 6 which electrically contact the auxiliary second electrical contact means 7 provided on the converter 5 when the latter is fully inserted into said aperture, in a manner completely analogous to the electrical connection described previously with reference to the plug-in member 5 and the socket 3 of the embodiment of FIG. 1.

A flexible electrical cable assembly 15 has one of its ends electrically connected with the auxiliary first electrical contact means 6 of auxiliary housing 20, as will be described in greater detail with respect to FIG. *3a* below, and the other of the ends of the cable assembly 15 is electrically connected to the second electrical contact means 7 of plug-in member 14, as will be described in greater detail with reference to FIG. *3b.*

Plug-in member 14 is essentially an electrical connector having wall portions similarly shaped and dimensioned as plug-in member 5 and is operative to conduct the electrical signals generated by the converter 5 to the first electrical contact means 6 of the socket 3. By such an arrangement, it is readily seen that the flexible shaft 11 of the mechanical drive means 10 may be connected at any convenient place in the vehicle, such as fire wall 21, which would not subject the flexible shaft 11 to undue or sharp bends. By mounting the auxiliary housing 20 at a location remote from the taximeter housing 1, it is the electrical cable assembly 15 which assumes the primary task of traversing the particular spatial dimensions between the drive component of the vehicle and the housing 1.

FIG. 3*a* shows one end of the cable assembly 15 entering directly, i.e. without bending, through the front face, that is the open side of the aperture 22, and held in place by the cable holders 23. Cable assembly 15 comprises a plurality of electrical wires 19 surrounded by a flexible protective cover. The electrical wires 19 are respectively wired to the auxiliary first electrical contact means 6 of auxiliary housing 20.

FIG. 3*b* shows the opposite end of the cable assembly 15 entering extension 16 from below. This cable end is received in the interior of plug-in member 14 and holds the cable 15 in a generally curved configuration by means of cable holders. Each of the electrical wires 19 is wired to the terminals 18 which are provided on the interior of plug-in member 14 and which are in direct electrical communication with the second electrical contact means 7 on the exterior of the plug-in member 14. Extension 16, like extension 9', serves as a convenient hand-grip for mounting and demounting of the plug-in member 14.

In both embodiments, housing 1 is further provided with a recess 4 which is adapted to receive strip bar 24. Strip bar 24 is provided with a row of input terminals which respectively connect the current source of the car, e.g. the battery or alternator, to energize the electronic circuitry of the taximeter, and a row of output terminals which energizes the fare-indicating device of the taximeter.

It is believed that the operation of the mounting and demounting arrangement of the taximeter is already clear from the above-given disclosure. To summarize briefly, FIG. 1 illustrates the direct mounting of the drive component, and more specifically, the mechanical drive means 10 to the taximeter. By sliding the male-like converter 5 directly into the female-like socket 3, a complete mechanical-electrical path is created. Additional modifications are not required.

If it is, however, difficult to couple the mechanical drive means 10 directly to the taximeter housing because of the given spatial relationships existing between the two such that sharp bending of the flexible shafts is required, then one can mount the converter 5 at a location away from the socket 3, either in the vicinity of the drive component of the vehicle itself, or at any other arbitrarily selected location intermediate the drive component and the socket 3. The remaining portion of the distance is traversed by the electrical cable assembly 15, as shown in FIG. 2. The auxiliary housing 20 and the plug-in member 14 are electrically connected at opposite ends of the cable assembly 15 to ensure that a complete path is established. In order to further prevent unauthorized withdrawal of the plug-in member from the socket 3, a seal such as a lead seal is commonly used.

It will be understood that each of the elements described above, or two or more together, may also find a useful application in other types of constructions differing from the types described above.

While the invention has been illustrated and described as embodied in an electrical taximeter mounting arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a transmitting arrangement for supplying electrical pulses to a taximeter by way of a flexible rotary mechanical drive shaft adapted to be driven by a drive component of the vehicle carrying the taximeter, a combination comprising a taximeter housing formed with a first socket of predetermined contour, and having first electrical contact means; an auxiliary housing mounted on the vehicle at a spacing remote from said taximeter housing and being provided with first auxiliary electrical contact means, said auxiliary housing having a second socket of substantially the same contour as said first socket; means for converting the mechanical rotary motion of the drive component into said electrical pulses, said converting means comprising an electromechanical transducer having a transducer plug-in portion of predetermined configuration which is complementary to the contour of said second socket for reception therein, said transducer plug-in portion having second auxiliary electrical contact means which registers in direct electrical contact with said first auxiliary electrical contact means when said transducer plug-in portion is fully received in said second socket, and a transducer extension portion projecting away from said auxiliary housing in direction opposite to the direction of insertion of said transducer plug-in portion into said second socket, said transducer extension portion being connected to said drive shaft at a location outwardly adjacent said second socket; and means for connecting said auxiliary housing with said taximeter housing, comprising an electrical connector having a connector plug-in portion of substantially the same configuration as the predetermined configuration of said transducer plug-in portion so that said connector plug-in portion is receivable in said first socket, said connector plug-in portion being provided with second electrical contact means which registers in direct electrical contact with said first electrical contact means when said connector plug-in portion is fully received in said first socket, and a connector extension portion projecting away from said taximeter housing in direction opposite to the direction of insertion of said connector plug-in portion into said first socket, and said connecting means further comprising a flexible electrical cable having one end region connected to said connector extension portion at a location outwardly adjacent said first socket and another end region connected to said auxiliary housing so as to complete an electromechanical connection.

2. A taximeter as recited in claim 1, wherein said transducer comprises rotatable means driven by said drive component of said vehicle.

3. A taximeter as recited in claim 1, wherein said plug-in portions have rectangularly-shaped wall portions, and said sockets have wall portions which are disposed at right angles to each other.

4. A taximeter as recited in claim 2, wherein said electro-mechanical transducer comprises an opening adapted to receive said flexible drive shaft.

5. A taximeter as recited in claim 1, wherein said flexible electrical cable comprises a plurality of electrical wires, each of whose opposite ends is respectively wired to said first auxiliary and second mating auxiliary electrical contact means, and a flexible protective cover surrounding said wires.

6. A taximeter as recited in claim 1, wherein said second electrical contact means and said second auxiliary electrical contact means are comprised of a plurality of electrical surface contacts, and wherein said first electrical contact means and said first auxiliary electrical contact means are comprised of a plurality of resilient snap-type electrical contacts respectively located at said first socket and said second socket, said resilient electrical contacts being operative for facilitating the mounting and securement of said plug-in portions into said sockets due to the resiliency of said resilient snap-type electrical contacts.

* * * * *